US006371568B1

(12) United States Patent
Waghorn

(10) Patent No.: US 6,371,568 B1
(45) Date of Patent: Apr. 16, 2002

(54) BRUSH HEAD MANUFACTURE

(75) Inventor: Howard J. Waghorn, Attleborough (GB)

(73) Assignee: Hamilton Acord Limited, Norfolk (GB)

( * ) Notice: Subject to any disclaimer, the term of this patent is extended or adjusted under 35 U.S.C. 154(b) by 0 days.

(21) Appl. No.: 09/431,692

(22) Filed: Nov. 1, 1999

(30) Foreign Application Priority Data

Jun. 11, 1999 (GB) ..... 9913655

(51) Int. Cl.[7] ..... A46B 3/02

(52) U.S. Cl. ..... 300/21; 15/193; 15/DIG. 4; 15/159.1; 15/204

(58) Field of Search ..... 300/21, 8; 15/204, 15/193, DIG. 4, 159.1, 160, 192, 191.1, 190

(56) References Cited

U.S. PATENT DOCUMENTS 1,616,858 A * 2/1927 Jacob
2,512,997 A * 6/1950 Bixler
3,733,638 A * 5/1973 Kaplan ..... 15/193
3,820,850 A * 6/1974 Weiss ..... 300/21
3,871,048 A * 3/1975 Leigh ..... 15/193

FOREIGN PATENT DOCUMENTS

GB 704590 * 2/1954 ..... 300/21
GB 856868 * 12/1960 ..... 15/192

* cited by examiner

*Primary Examiner*—Gary K. Graham
(74) *Attorney, Agent, or Firm*—Pearne & Gordon LLP

(57) ABSTRACT

A method of manufacturing a brush head, comprises: locating in a ferrule the basal end portion of a knot of bristles; compressing at least one wedge of resiliently deformable material by an amount such that the wedge or wedges remains capable of recovering to its or their original size and shape; before the wedge or wedges have recovered to their original size and shape, inserting them into the basal end portion of the knot of bristles in the ferrule; the wedge or wedges, as it or they recover compressing the bristles against an inside surface of the ferrule to enhance retention o the bristles by the ferrule; impregnating the basal end portion of the knot of bristles with liquid resin; and thereafter allowing or causing the resin to harden to retain the basal end portion of the knot of bristles in the ferrule.

9 Claims, 1 Drawing Sheet

BRUSH HEAD MANUFACTURE

BACKGROUND OF THE INVENTION

The present invention relates to a method of manufacturing brush heads.

The invention is particularly, but not exclusively, applicable to brush heads such as for paint brushes and other brushes used in decorating.

Conventional brushes comprise a handle and a head which has a ferrule attached to the handle and a knot of natural or synthetic bristles or filaments (hereinafter referred to as "bristles"), the basal end portion of which is embedded in hardened epoxy resin, which retains the basal end portion of the knot of bristles in the ferrule, the remainder of the knot of bristles protruding from the ferrule.

In manufacture of such a brush head, the end portion of the knot of bristles is located in the ferrule and then is impregnated with uncured (liquid) epoxy resin (incorporating hardener or curing agent), which hardens or cures. It is necessary that the basal end portion of the knot of bristles is gripped by the ferrule until the resin has hardened or cured, in order to prevent or reduce loss of bristles from the bush head.

In order to enhance the gripping of the bristles by the ferrule one or more wedges (which may be up to nine in number) may be located in the ferrule.

When one or more wedges are used, the knot of bristles is inserted, tip end first, into the ferrule, then the wedge is or the wedges are inserted into the knot at the basal end of the knot, and then the knot is moved relative to the ferrule (this step is referred to as "pull up") to its desired final position relative to the ferrule, to leave a cavity between one end of the ferrule and the basal end of the knot, the bristles projecting from the other end of the ferrule. The resin is then introduced into the cavity.

Conventionally the wedges are made of balsa, plywood, cardboard or hard plastics material. When the wedges are of cardboard the number required varies from two up to nine. The wedges are simple fed into the knot of bristles in the ferrule and are static, i.e. they do not fill any void left between the bristles and the inside surface of the ferrule.

The knot of bristles is picked by cross section but because of variations in bristle weight and density the volume of bristle located in the ferrule varies from ferrule to ferrule. If the volume is too low the wedges will not fill voids left between the bristles and the inside surface of the ferrule to ensure a tight fit of the bristles in the ferrule and the knot may accordingly be too loosely held in the ferrule. If the volume is too high the bristle may accordingly be too tightly held in the ferrule. As a result, if the bristles are too loosely held in the ferrule, before the resin has been impregnated into the basal end portion of the bristles and the resin has cured, bristles may fall out of the ferrule or the knot may slide or drop from its desired position relative to the ferrule, or if the knot is too tightly held in the ferrule the sides of the ferrule may bow outwardly, thereby preventing or hindering the subsequent location of an end of the handle in the ferrule. Consequently wastage occurs because unsatisfactory brush heads have to be rejected and down-time of the brush head manufacturing equipment arises for adjustment to be made to the cross-section of bristle picked for each knot or the number of wedges used in each brush head.

SUMMARY OF THE INVENTION

The present invention aims, at least in its preferred embodiments, to overcome the aforementioned disadvantages.

In accordance with the present invention there is provided a method of manufacturing a brush head, comprising: locating in a ferrule the basal end portion of a knot of bristles; compressing at least one wedge of resiliently deformable material by an amount such that the wedge or wedges remains capable of recovering to its or their original size and shape; before the wedge or wedges have recovered to their original size and shape, inserting them into the basal end portion of the knot of bristles in the ferrule; the wedge or wedges, as it or they recover compressing the bristles against an inside surface of the ferrule to enhance retention of the bristles by the ferrule; impregnating the basal end portion of the knot of bristles with liquid resin; and thereafter allowing or causing the resin to harden to retain the basal end portion of the knot of bristles in the ferrule.

The compression of the wedge or wedges, prior to its or their being inserted into the ferrule, may be effected by squeezing the wedge or wedges through a set of rollers.

Preferably the wedge or wedges are compressed in a direction transverse to the direction in which they are to be inserted into the knot of bristles. Preferably the wedge or wedges are elongate and the direction in which each is compressed is its thickness direction, transverse to its length.

Preferably the or each wedge is compressed by an amount such as to reduce its linear dimension in the direction of compression by at least 5%, more preferably 15%.

Preferably the wedge or wedges are inserted at the basal ends of the bristles with the bristles located in an initial position in the ferrule and then pull up is effected to bring the knot to its desired final position relative to the ferrule.

Preferably, the amount of bristle located in the ferrule is such that the linear dimension of the wedge or wedges in the direction of compression is prevented from recovering to more than 95% of its original value, although a satisfactory brush head is obtained if all voids in the ferrule are filled when the linear dimension of the wedge or each wedge in the direction of compression has recovered to 100% of its original value.

The wedge may be of a microcellular polymer, e.g. polyvinylchloride (PVC).

Since the wedge or wedges recover any deficiency in the volume of the basal end portion of the bristles located in the ferrule is accommodated. Even if the volume of the basal end portion of the bristles is high, although the recovery of the wedge or wedges will be restricted there is only a small risk of the sides of the ferrule bowing. Thus the problem of reject heads is substantially removed, thereby reducing wastage of brush heads and down-time of the brush head manufacturing equipment.

The bristles are held in the. ferrule under a pressure exerted by the wedges such as to allow even penetration of the resin. This also prevents the bristles dropping out of the ferrule during storage, transport or other processing prior to resin setting (hardening or curing) and therefore reduces rejects at the head finishing stage.

Normally no more than two wedges are required in each brush head.

It will be understood by those skilled in the art that the wedges used need not be of tapering section.

BRIEF DESCRIPTION OF THE DRAWINGS

The invention is illustrated by the accompanying drawings, wherein.

DETAILED DESCRIPTION OF THE PREFERRED EMBODIMENTS

Figure 1:
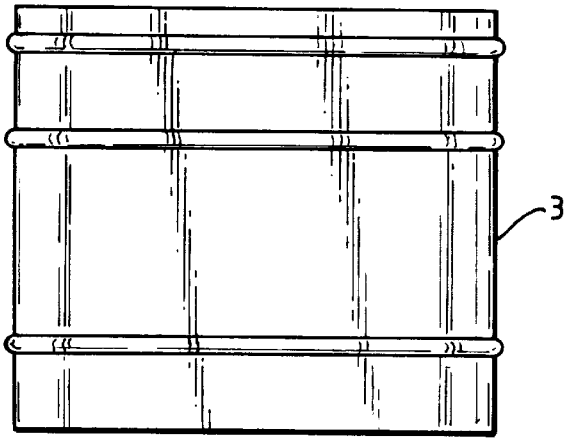
FIG. 1 is a front view of a ferrule.
Figure 2:
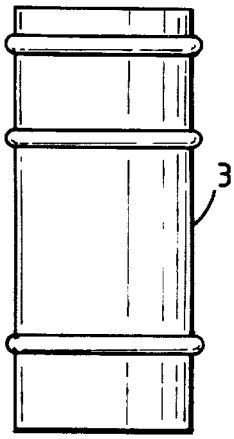
FIG. 2 is a side view of the ferrule.
Figure 3:
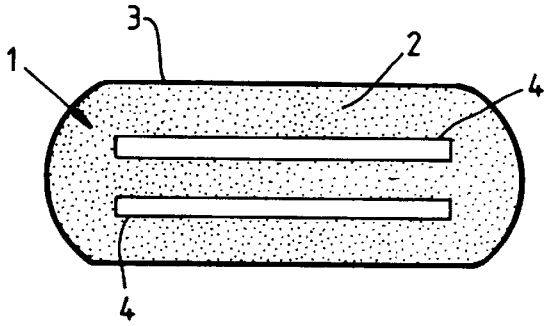
FIG. 3 is a cross-section through a brush head manufactured in accordance with the invention.

Referring to FIGS. 1 to 3 of the drawings, a method according to the invention is carried over by a machine. The machine inserts the basal end portion 2 of a knot 1 of bristles into a ferrule 3 so that the basal end of the knot is approximately flush with one end of the ferrule and the other, tip end of the knot protrudes from the other end of the ferrule.

A pair of wedges 4 are passed between a pair of rollers in their lengthwise direction and thereby squeezed. The wedges 4 are each in the form of a rectangular section strip, of breadth about six times greater than its thickness, and are made of flexible and resilient microcellular PVC of British Standard softness 30. This material is soft relative to the bristles. The wedges 4 are squeezed between the rollers to compress them in their thickness direction by about 25%. This leaves the wedges 4 capable of recovering to their original size and shape within about five minutes when unconstrained.

The wedges 4, having been squeezed between the rollers, and before they have recovered by more than 5% towards their original size (thickness dimension) are inserted into the basal end portion of the knot of bristles. As the wedges 4 recover further towards their original size and shape they press the bristles against the inside surface of the ferrule 3, thereby holding the bristles in position with an optimum tightness of fit.

Pull up is then effected by two jaws pinching the tip end of the knot of bristles between them and pulling the knot of bristles, together with the wedges, away from said one end of the ferrule towards the other end of the ferrule by a predetermined distance, thereby forming a cavity in the ferrule between said one end and the basal end of the knot. The ferrule 3, with the bristles and the wedges, located therein, then exits the machine and conventional head finishing is effected. (It would alternatively be possible to use a mandrel to effect pull up, is if pull up were to be effected manually.)

A metered amount of epoxy resin (mixed with hardener) is then introduced at the cavity in the ferrule 3. Since the bristles are held in the ferrule with an optimum tightness of fit even penetration of resin into the basal end portion of the knot of bristles occurs. The resin is then allowed to harden (cure) thereby firmly and permanently locating and retaining the bristles in the ferrule. A handle (not shown in the drawings) is then attached to the ferrule 3, an end portion of the handle being located in the cavity in the ferrule, in conventional manner and head finishing is carried out to complete the brush.

The dimensions of the wedges 4 and the amount of bristle selected should ideally be such that the wedges are unable to recover fully to their original size and shape, whereby the bristles are continuously pressed against the inside surface of the ferrule until the resin has hardened. Ideally, the amount of bristle selected should be such that the thickness dimensions of the wedges have recovered to no more than 95% of their original value when the bristles are firmly pressed against the inside surface of the ferrule. However, the brush head would be satisfactory even if the thickness dimensions of the wedges recovered to 100% of their original values provided that no voids are left in the ferrule.

The softness of the material of the wedges 4 means that there is only a small risk of the wedges, on recovery, exerting sufficient force against the sides of a ferrule to cause the sides to bow.

The pressure exerted by the wedges 4 serve to hold the bristles in position in the ferrule during any storage or transport necessary after pull up and before the introduction of the resin.

The wedges 4 may be abraded prior to being inserted into the ferrule in order to provide enhanced adhesion of the resin to the wedges as compared with adhesion of the resin to cardboard wedges.

Figure 4:
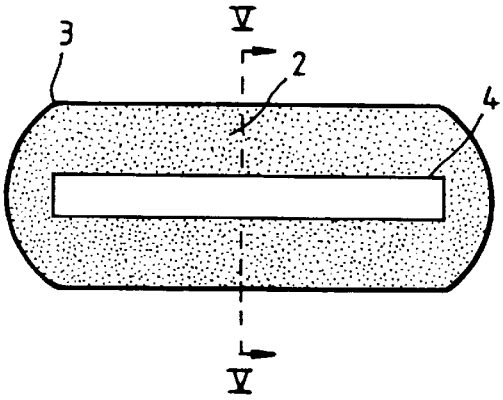
FIG. 4 is a cross-section through another brush head manufactured in accordance with the invention.
Figure 5:
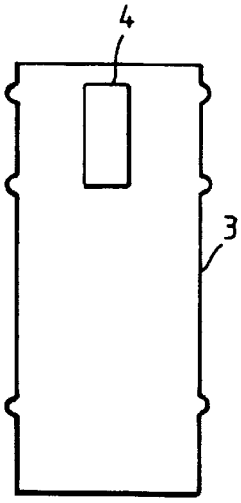
FIG. 5 is a section along line V—V of FIG. 4.

FIGS. 4 and 5 show a brush head manufactured in similar manner to that of FIG. 3 but using only one wedge. The bristles are omitted in FIG. 5 for the sake of clarity. Like reference numerals are used in FIGS. 4 and 5 as in FIG. 3.

What is claimed is:

1. A method of manufacturing a brush head, comprising: locating in a ferrule a basal end portion of a knot of bristles; compressing at least one wedge of resiliently deformable material by an amount such that the at least one wedge remains capable of recovering to its original size and shape; before the at least one wedge has recovered to its original size and shape, inserting the at least one wedge into the basal end portion of the knot of bristles in the ferrule; the at least one wedge, as it recovers compressing the bristles against an inside surface of the ferrule to enhance retention of the bristles by the ferrule; impregnating the basal end portion of the knot of bristles with liquid resin; and thereafter the resin hardens to retain the basal end portion of the knot of bristles in the ferrule.

2. The method according to claim 1, wherein the compression of the at least one wedge, prior to its being inserted into the ferrule, is effected by squeezing the at least one wedge through a set of rollers.

3. The method according to claim 1, wherein the at least one wedge is compressed in a direction transverse to the direction in which it is to be inserted into the knot of bristles.

4. The method according to claim 1, wherein the at least one wedge is elongate and the direction in which each is compressed is its thickness direction, transverse to its length.

5. The method according to claim 1, wherein the at least one wedge is compressed by an amount such as to reduce its linear dimension in the direction of compression by at least 5%.

6. The method according to claim 5, wherein the at least one wedge is compressed by an amount such as to reduce its linear dimension in the direction of compression by at least 15%.

7. The method according to claim 1, wherein the at least one wedge is inserted at the basal ends of the bristles with the bristles located in an initial position in the ferrule and then pull up is effected to bring the knot to its desired final position relative to the ferrule.

8. The method according to claim 1, wherein the amount of bristle located in the ferrule is such that the linear dimension of the at least one wedge in the direction of compression is prevented from recovering to more than 95% of its original value.

9. The method according to claim 1, wherein the at least one wedge is of a microcellular polymer.

* * * * *

UNITED STATES PATENT AND TRADEMARK OFFICE

CERTIFICATE OF CORRECTION

PATENT NO. : 6,371,568 B1
DATED : April 16, 2002
INVENTOR(S) : Howard J. Waghorn It is certified that error appears in the above-identified patent and that said Letters Patent is hereby corrected as shown below:

Title page,
Item [73], Assignee:, delete "Hamilton Acord Limited" and insert
-- Hamilton Acorn Limited --.

Signed and Sealed this

Twenty-third Day of July, 2002

*Attest:*

*Attesting Officer*

JAMES E. ROGAN
*Director of the United States Patent and Trademark Office*